US006788133B2

(12) United States Patent
Liu et al.

(10) Patent No.: US 6,788,133 B2
(45) Date of Patent: Sep. 7, 2004

(54) REFERENCE VOLTAGE PROVIDING CIRCUIT

(75) Inventors: Han-Chi Liu, Kaohsiung (TW); Wen-Cheng Yen, Taichung (TW)

(73) Assignee: Faraday Technology Corp., Hsinchu (TW)

( * ) Notice: Subject to any disclaimer, the term of this patent is extended or adjusted under 35 U.S.C. 154(b) by 0 days.

(21) Appl. No.: 10/336,738

(22) Filed: Jan. 6, 2003

(65) Prior Publication Data

US 2004/0130386 A1 Jul. 8, 2004

(51) Int. Cl.[7] ..... G05F 1/10; G05F 3/02

(52) U.S. Cl. ..... 327/540; 327/544

(58) Field of Search ..... 327/530, 538, 327/540, 541, 544, 545, 543

(56) References Cited

U.S. PATENT DOCUMENTS 6,326,837 B1 * 12/2001 Matano ..... 327/545
6,339,357 B1 * 1/2002 Yamasaki et al. ..... 327/538

* cited by examiner

*Primary Examiner*—Quan Tra
(74) *Attorney, Agent, or Firm*—Rabin & Berdo, P.C.

(57) ABSTRACT

A reference voltage providing circuit. The operation amplifier includes a non-reverse input terminal, a reverse input terminal and an output terminal coupled to the reverse input terminal for outputting an output voltage. The reference voltage generator is coupled to the non-reverse input terminal. The loading is coupled to the output terminal. The current source provides a starting current. The switching device is coupled between the current source and the output terminal, and turned on by an accelerating charging signal to pass the starting current to the loading through the first output terminal. The pulse output device outputs the accelerating charging signal.

11 Claims, 3 Drawing Sheets

REFERENCE VOLTAGE PROVIDING CIRCUIT

BACKGROUND OF THE INVENTION

1. Field of the Invention

The present invention relates in general to operation amplifiers (operational amplifiers). In particular, the present invention relates to an additional current source provided to accelerate the reference voltage output from the operation amplifier (operational amplifier) to a desired voltage.

2. Description of the Related Art

In a variety of systems of practical importance, a highly precise reference voltage source and operation speed is required. Conventionally, a standard reference voltage source is utilized to drive a relatively large capacitive load. FIG. 1 shows a conventional circuit diagram of an amplifier receiving a reference voltage to drive the large capacitive loading 14. The non-reverse input terminal of the operation amplifier (operational amplifier) 10 receives a reference voltage provided by a reference voltage generator 12, and outputs a voltage to drive the loading 14. The output voltage of the operation amplifier 10 is fed back to the reverse input terminal of the operation amplifier 10 and keeps increasing until reaching the reference voltage. However, the capacitance of the loading influences the time of the output voltage of the operation amplifier 10 reaching the reference voltage, that is, the larger the capacitance of the loading, the longer the time required for the output voltage to reach the target value. Moreover, the delay is more serious when starting up the circuit, which takes a lot of restoring time to charge the capacitive loading.

SUMMARY OF THE INVENTION

The object of the present invention is to provide a reference voltage providing circuit, which decreases restoring time after starting up and powering down.

To achieve the above-mentioned object, the reference voltage providing circuit includes an operation amplifier, a reference voltage generator, a current source, a switching device, and a pulse output device. The operation amplifier (operational amplifier) includes a non-reverse input terminal, a reverse input terminal and an output terminal coupled to the reverse input terminal for outputting an output voltage. The reference voltage generator is coupled to the non-reverse input terminal. The loading is coupled to the output terminal. The current source provides a starting current. The switching device is coupled between the current source and the output terminal, and turned on by an accelerating charging signal to pass the starting current to the loading through the output terminal. The pulse output device outputs the accelerating charging signal.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
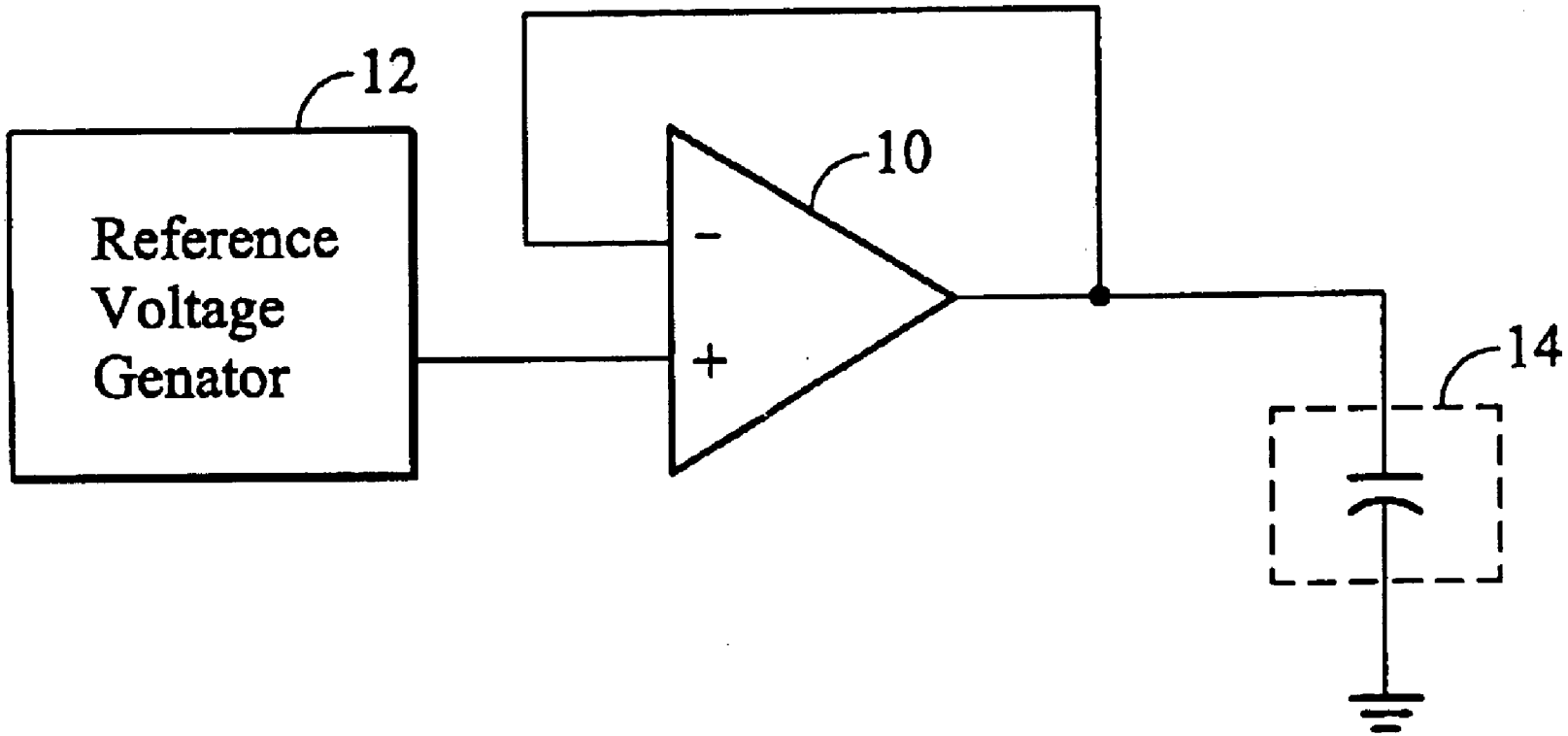
FIG. 1 (PRIOR ART)
FIG. 1 shows a conventional circuit diagram of an amplifier receiving a reference voltage to drive the large capacitive loading.
Figure 2:
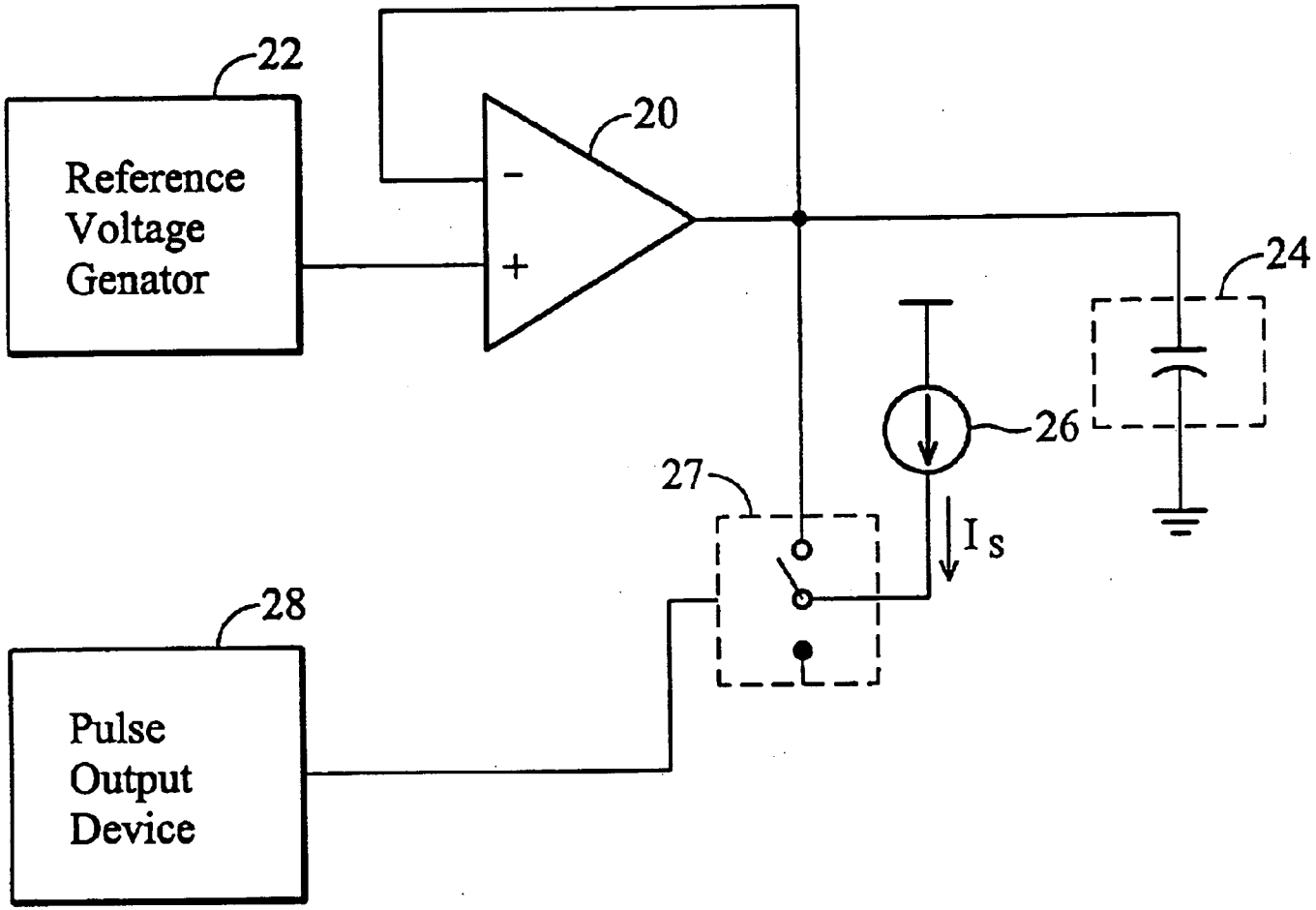
FIG. 2 shows the reference voltage providing circuit according to the first embodiment of the present invention.

FIG. 2 shows the reference voltage providing circuit according to the first embodiment of the present invention. The reference voltage providing circuit according to the first embodiment of the present invention comprises an operation amplifier 20, a reference voltage generator 22, a loading 24, a current source 26, a switching device 27, and a pulse output device 28. The operation amplifier (operational amplifier) 20 comprises a non-reverse input terminal, a reverse input terminal and an output terminal coupled to the reverse input terminal for outputting an output voltage. The reference voltage generator 22 is coupled to the non-reverse input terminal of the operation amplifier 20. The loading 24 is coupled to the output terminal. Here, the loading 24 is capacitive.

In addition, the current source 26 provides an additional starting current Is. The switching device 27 is coupled between the current source 26 and the output terminal, and is turned on by an accelerating charging signal to pass the starting current Is to the loading 24 through the output terminal. The pulse output device 28 outputs the accelerating charging signal. If the capacitance of the loading 24 is known, the accelerating charging signal has a fixed pulse width corresponding to the capacitance of the loading. The larger the capacitance, the greater the pulse width of the accelerating charging signal.

The non-reverse input terminal of the operation amplifier 20 receives a reference voltage provided by a reference voltage generator 22, and outputs a voltage to drive the loading 24. The output voltage of the operation amplifier 20 is fed back to the reverse input terminal of the operation amplifier 20 and keeps increasing until reaching the reference voltage. When the circuit starts up, the accelerating charging signal turns on the switching device 27 to induce the starting current Is provided by the current source 26 to the loading 24 through the output terminal of the operation amplifier 20 to increase the charging rate of the loading 24. Thus, the restoring time after power up is decreased.

Second Embodiment

Figure 3:
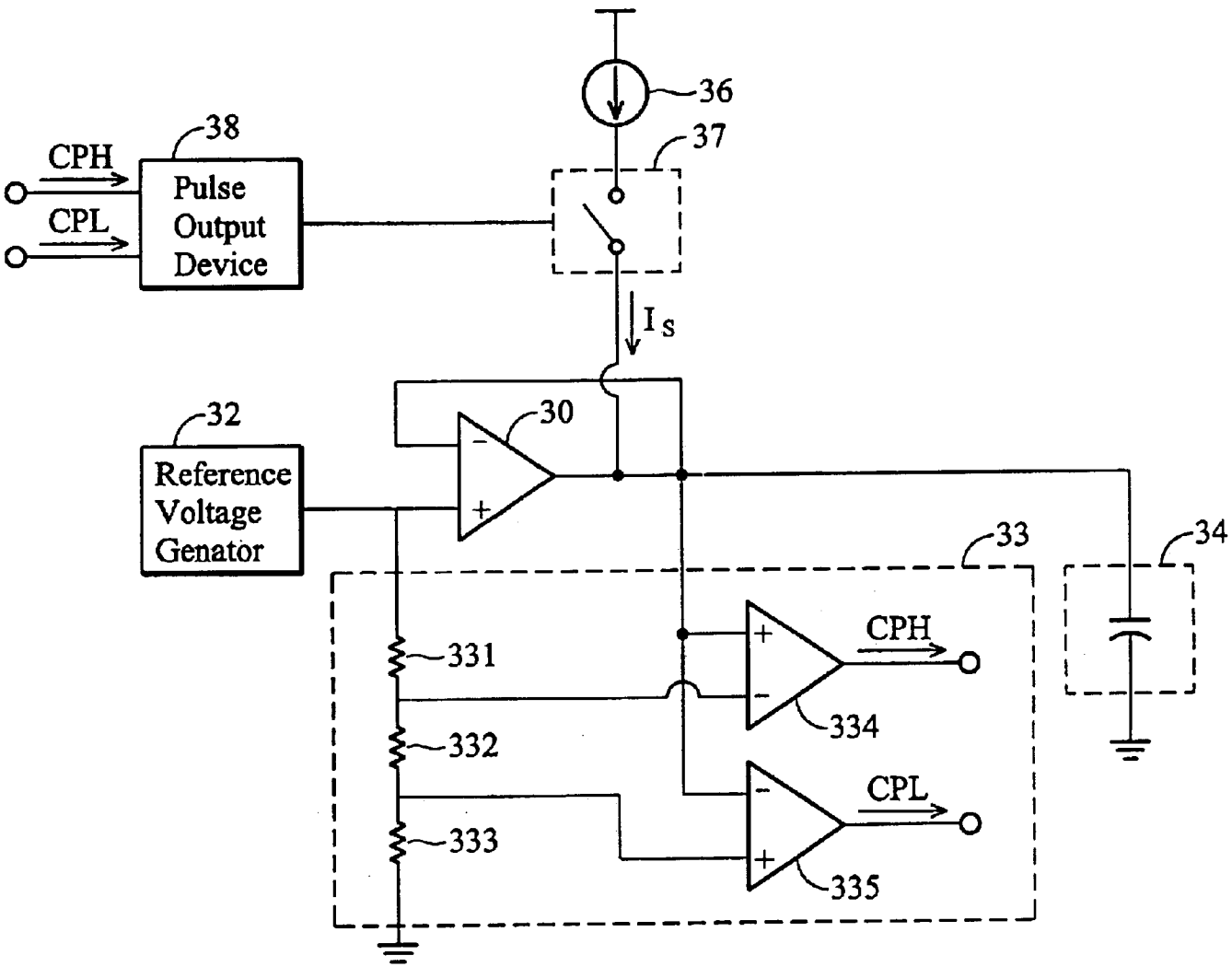
FIG. 3 shows the reference voltage providing circuit according to the second embodiment of the present invention.

FIG. 3 shows the reference voltage providing circuit according to the second embodiment of the present invention. The reference voltage providing circuit according to the second embodiment of the present invention comprises an operation amplifier 30, a reference voltage generator 32, a voltage detection device 33, a loading 34, a current source 36, a switching device 37, and a pulse output device 38. The operation amplifier 30 comprises a non-reverse input terminal, a reverse input terminal and an output terminal coupled to the reverse input terminal for outputting an output voltage. The reference voltage generator 32 is coupled to the non-reverse input terminal of the operation amplifier 30. The loading 34 is coupled to the output terminal. Here, the loading 34 is capacitive.

In addition, the current source 36 provides an additional starting current Is. The switching device 37 is coupled between the current source 36 and the output terminal, and is turned on by an accelerating charging signal to pass the starting current Is to the loading 34 through the output terminal. The pulse output device 38 outputs the accelerating charging signal.

The pulse output device 38 is controlled by the voltage detection device 33. The voltage detection device 33 comprises a plurality of resistors and two comparators. The resistor 331 is coupled to the reference voltage generator 32. The resistor 333 is coupled to the ground level, and the resistor 332 is coupled between the resistors 331 and 333. The comparator 334 comprises a reverse input terminal coupled to the connection point of the resistor 331 and 332, a non-reverse input terminal coupled to the output terminal of the operation amplifier 30, and an output terminal for outputting a disabling signal CPH. The comparator 335 comprises a non-reverse input terminal coupled to the connection point of the resistors 332 and 333, a reverse input terminal coupled to the output terminal of the operation amplifier 30 and an output terminal for outputting an enabling signal CPL.

The voltage of the connection point of the resistor 331 and 332 is higher than the connection point of the resistors 332 and 333. Therefore, when the output voltage of the operation amplifier 30 is lower than the voltage of the connection point of the resistors 332 and 333, the enabling signal CPL is output, and when the output voltage of the operation amplifier 30 is higher than the voltage of the connection point of the resistor 332 and 331, the disabling signal CPH is output. Here, the voltages of the connection point of the resistor 332 and 331 and the connection point of the resistors 332 and 333 are designed by setting the resistor values.

Therefore, the pulse output device 38 starts to output the accelerating charging signal at a high level when receiving the enabling signal CPL and stops when receiving the disabling signal CPH. Therefore, the pulse width of the accelerating charging signal is adjusted dynamically.

The non-reverse input terminal of the operation amplifier 30 receives a reference voltage provided by a reference voltage generator 32, and outputs a voltage to drive the loading 34. The output voltage of the operation amplifier 30 is fed back to the reverse input terminal of the operation amplifier 30. When the pulse output device 38 receives the enabling signal CPL, the accelerating charging signal is output to turn on the switching device 37 to induce the starting current Is provided by the current source 36 to the loading 34 through the output terminal of the operation amplifier 30 to increase charging rate of the loading 34. After the pulse output device 38 receives the disabling signal CPH, the switching device 37 is turned off to stop the starting current Is charging the loading 34. Thus, the restoring time after powering up is decreased, and the charging operation is disabled automatically when the voltage of the loading reaches a predetermined value to avoid power consumption.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A reference voltage providing circuit, comprising:

an operational amplifier having a first non-reverse input terminal, a first reverse input terminal and an output terminal coupled to the first reverse input terminal for outputting an output voltage;

a reference voltage generator coupled to the first non-reverse input terminal;

a loading coupled to the output terminal;

a current source for providing a starting current;

a switching device coupled between the current source and the output terminal, and turned on by an accelerating charging signal to pass the starting current to the loading through the output terminal;

a pulse output device for outputting the accelerating charging signal; and a voltage detection device for detecting the output voltage, outputting an enabling signal to start the pulse output device when the output voltage is lower than a first voltage, and outputting a disabling signal to turn off the pulse output device when the output voltage is higher than a second voltage.

2. The reference voltage providing circuit as claimed in claim 1, wherein the loading is capacitive.

3. The reference voltage providing circuit as claimed in claim 1, wherein the output terminal is a first output terminal, and wherein the voltage detection device includes:

a first resistor coupled to the reference voltage generator;

a second resistor coupled to the first resistor;

a third resistor coupled between the second resistor and a ground level;

a first comparator having a second reverse input terminal coupled to the connection point of the first resistor and the second resistor, a second non-reverse input terminal coupled to the first output terminal and a second output terminal for outputting the disabling signal; and a second comparator having a third non-reverse input terminal coupled to the connection point of the second resistor and the third resistor, a third reverse input terminal coupled to the first output terminal and a third output terminal for outputting the enabling signal.

4. The reference voltage providing circuit as claimed in claim 2, wherein the pulse output device outputs the accelerating charging signal, and wherein the accelerating charging signal has a fixed pulse width according to the capacitance of the loading.

5. A reference voltage providing circuit, comprising:

an operational amplifier having a first non-reverse input terminal, a first reverse input terminal, an output terminal coupled to the first reverse input terminal for outputting an output voltage, a current source for providing a starting current, and a switching device coupled between the current source and the output terminal;

a reference voltage generator coupled to the first non-reverse input terminal;

a loading coupled to the output terminal;

a pulse output device for outputting the accelerating charging signal to turn on the switching device so as to pass the starting current to the loading through the output terminal; and a voltage detection device for detecting the output voltage, and outputting an enabling signal to start the pulse output device when the output voltage is lower than a first voltage, and outputting a disabling signal to turn off the pulse output device when the output voltage is higher than a second voltage.

6. The reference voltage providing circuit as claimed in claim 5, wherein the loading is capacitive.

7. The reference voltage providing circuit as claimed in claim 5, wherein the output terminal is a first output terminal, and wherein the voltage detection device includes:

a first resistor coupled to the reference voltage generator;

a second resistor coupled to the first resistor;

a third resistor coupled between the second resistor and a ground level;

a first comparator having a second reverse input terminal coupled to the connection point of the first resistor and the second resistor, a second non-reverse input terminal coupled to the first output terminal and a second output terminal for outputting the disabling signal; and a second comparator having a third non-reverse input terminal coupled to the connection point of the second resistor and the third resistor, a third reverse input terminal coupled to the first output terminal and a third output terminal for outputting the enabling signal.

8. The reference voltage providing circuit as claimed in claim 6, wherein the accelerating charging signal pulse output by the pulse output device has a pulse width according to the capacitance of the loading.

9. A reference voltage providing circuit, comprising:

an operational amplifier having a first non-reverse input terminal, a first reverse input terminal, and an output terminal coupled to the first reverse input terminal for outputting an output voltage;

a reference voltage generator coupled to the first non-reverse input terminal;

a capacitive loading coupled to the output terminal;

a current source for providing a starting current;

a switching device coupled between the current source and the output terminal, and turned on by an accelerating charging signal to pass the starting current to the capacitive loading through the output terminal;

a pulse output device for outputting the accelerating charging signal; and a voltage detection device for detecting the output voltage, outputting an enabling signal to start the pulse output device when the output voltage is lower than a first voltage, and outputting a disabling signal to turn off the pulse output device when the output voltage is higher than a second voltage.

10. The reference voltage providing circuit as claimed in claim 9, wherein the output terminal is a first output terminal, and wherein the voltage detection device includes:

a first resistor coupled to the reference voltage generator;

a second resistor coupled to the first resistor;

a third resistor coupled between the second resistor and a ground level;

a first comparator having a second reverse input terminal coupled to the connection point of the first resistor and the second resistor, a second non-reverse input terminal coupled to the first output terminal and a second output terminal for outputting the disabling signal; and a second comparator having a third non-reverse input terminal coupled to the connection point of the second resistor and the third resistor, a third reverse input terminal coupled to the first output terminal and a third output terminal for outputting the enabling signal.

11. The reference voltage providing circuit as claimed in claim 9, wherein the accelerating charging signal output by the pulse output device has a fixed pulse width according to the capacitance of the capacitive loading.

* * * * *